United States Patent [19]

Weiss et al.

[11] 4,238,076

[45] Dec. 9, 1980

[54] APPARATUS FOR BUILDING UP AND REPAIRING THE REFRACTORY LINING OF INDUSTRIAL FURNACES AND HOT-RUNNING VESSELS

[75] Inventors: Franz Weiss; Franz Waisnix, both of Vienna; Friedrich Baumgartner; Werner Zach, both of Veitsch, all of Austria

[73] Assignee: Veitscher Magnesitwerke-Actien-Gesellschaft, Vienna, Austria

[21] Appl. No.: 13,173

[22] Filed: Feb. 21, 1979

[30] Foreign Application Priority Data

Feb. 22, 1978 [AT] Austria ..... 1294/78

[51] Int. Cl.[3] ..... F27D 1/16

[52] U.S. Cl. ..... 239/676; 239/214.25; 222/310; 366/182; 266/281; 264/30

[58] Field of Search ..... 239/662, 676, 687, 214.25, 239/222, 223, 224; 222/310, 317; 366/169, 182, 192, 193; 266/281; 264/30

[56] References Cited

U.S. PATENT DOCUMENTS

| | | | |
|---|---|---|---|
| 1,459,955 | 6/1923 | Johnson | 222/310 X |
| 1,674,391 | 6/1928 | Dunnagan | 222/317 |
| 2,177,093 | 10/1939 | Burke | 366/182 X |
| 2,217,318 | 10/1940 | Nanna | 366/182 X |
| 2,225,058 | 12/1940 | Langhaus | 366/182 |
| 3,104,424 | 9/1963 | Immel | 366/182 X |
| 3,179,377 | 4/1965 | Orr | 366/182 |
| 3,976,109 | 8/1976 | Bailey | 366/182 X |
| 4,033,514 | 7/1977 | Weiss et al. | 239/687 X |
| 4,108,384 | 8/1978 | Egli . | |

FOREIGN PATENT DOCUMENTS

| | | | |
|---|---|---|---|
| 1193646 | 6/1970 | United Kingdom | 222/310 |

*Primary Examiner*—Robert W. Saifer
*Attorney, Agent, or Firm*—Kurt Kelman

[57] ABSTRACT

In an apparatus for building up and repairing a refractory lining of an industrial furnace, the material is centrifugally deposited by a wheel rotated by a vertical drive shaft passing through a hopper and a mixing chamber connected thereto. A shut-off bell member having a bevelled lower edge is slidably mounted on the mounting housing of the shaft for vertical movement into selected positions wherein the bevelled lower edge defines an annular gap between the hopper and the mixing chamber for permitting the granular refractory material to flow from the hopper into the chamber and the bevelled lower edge engages the conical inside wall surface of the hopper for completely closing the annular gap for interrupting the flow. The vertical movement is effected by a pneumatic motor attached to the bell member by means of a linkage and rods.

1 Claim, 2 Drawing Figures

Figure 1:
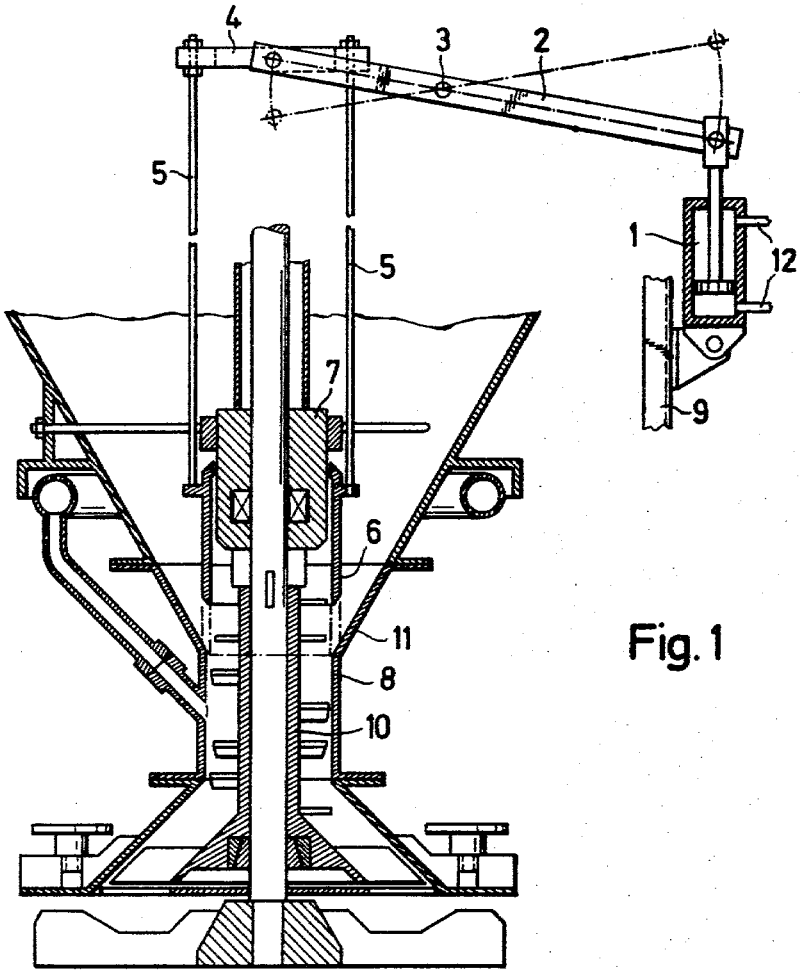

APPARATUS FOR BUILDING UP AND REPAIRING THE REFRACTORY LINING OF INDUSTRIAL FURNACES AND HOT-RUNNING VESSELS

The invention relates to apparatus for building up and repairing the refractory lining of industrial furnaces and hot-running vessels, by the precision centrifugal depositing of granular refractory material on the positions of the lining which are to be built up or repaired, comprising a centrifuging wheel which is arranged so that it can be lowered into the interior of the furnace or vessel and which is mounted rotatably in a horizontal plane and to which the refractory material can be fed by way of a conduit which opens above the centrifuging wheel, the vertical drive shaft for the centrifuging wheel passing through the conduit and the conduit being connected to a mixing chamber whose upper end is connected to a preferably conical material container.

In these known apparatus, it is necessary for the amount of material which is to be fed to the centrifuging wheel to be continuously metered. This is effected by vertical adjustable sliders or by the provision of a masking plate which is arranged above the centrifuging wheel and which has through-flow openings whose size and/or position can be varied for example by means of slider plates.

However, the wear situation in refractory linings of industrial furnaces and hot-running vessels is moreover such that the amount of material required for each repair cannot be precisely determined from the outset. This fact means that, in most cases, too much or too little material is used when filling the machines. As the machine must be run down to an empty condition in each repair, that is to say, no material can remain in the conveyor portion, repair cannot be carried out in the optimum manner from the economic and/or technical point of view, in accordance with the state of the art at the present day.

The problem of the invention is to provide the above-mentioned apparatus with a closure member by means of which the material container of the machine can firstly be completely filled with material and the amount of material to be centrifugally deposited can be individually controlled, depending on the extent of repair required at the worn position.

The invention solves this problem in that a closure member for completely closing off the material container from the mixing chamber is arranged at the transition between the mouth of the material container and the mixing chamber.

Preferably, the closure member is a shut-off bell member which is guided on the mounting housing of the drive shaft and which is arranged so that it can be lifted, and lowered to a position of completely closing the annular gap between the bell member and the material container.

According to the invention, it is thus possible for precisely selectable amounts of refractory material to be fed to the mixing chamber for each repair, so that it is then only necessary for the actual mixing chamber and not the entire material container, as was previously required, to be run down to an empty condition. This is of great importance from the economic and technical point of view. Further advantages are that the operating times and costs are considerably reduced by the reduced filling operations and an additional step towards automation is made possible as the machines can be charged directly from silos without expensive ancilliary constructions such as belt weighing devices etc. Repairs can be carried out in the optimum manner as the conveyance of material during the repair operation can be interrupted as required by closing the annular gap, so that it is possible better to observe the repaired position and on the basis of which a precision depositing operation may be carried out in the best possible manner.

The invention also provides that the shut-off bell member can be raised and lowered by way of vertical rods which are secured to a mounting means and by way of a linkage system which engages the mounting means and which is pivotal about a horizontal axis and which at the other end is pivotally connected to the piston of a stationary pneumatically actuated cylinder unit. In this way the lifting stroke movement of the bell member and the width of the annular gap may be regulated in a particularly simple manner by adjusting the stroke length at the pneumatically actuated cylinder unit.

According to the invention, it is also possible for the lower edge of the shut-off bell member to be bevelled to correspond to the inside wall surface of the conical material container. This feature ensures that the annular gap is reliably closed off.

Figure 2:
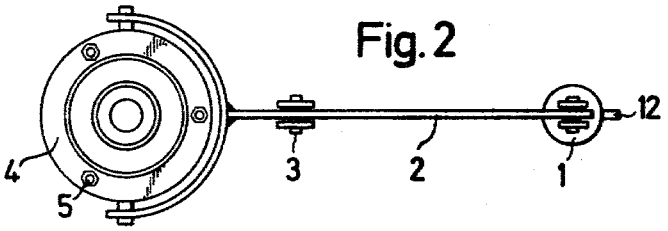

The invention is illustrated in greater detail in the drawing with reference to an embodiment. In the drawing:

FIG. 1 shows the shut-off bell member according to the invention in apparatus for building up and repairing the refractory lining of industrial furnaces, in a vertical sectional view, and FIG. 2 shows a plan view of the linkage system for the shut-off bell member.

Referring to FIG. 1, it will be seen that the known apparatus for building up and repairing the refractory lining of industrial furnaces and hot-running vessels comprises a conical material container 11, a cylindrical mixing chamber 8 which adjoins thereto and a feed conduit which extends downwardly from the mixing chamber 8. Below the feed conduit, a centrifuging wheel is carried by a vertical drive shaft which is arranged rotatably in a mounting housing 7 and which comprises a conveyor portion 10, that is to say, a screw or the like, which passes through the mixing chamber 8 and the feed conduit therebelow.

According to the invention, a shut-off bell member 6 which is guided on the mounting housing 7 is provided at the transition between the tapered material container 11 and the mixing chamber 8. The lower edge of the bell member 6 can be so bevelled that, in the closed position shown in dash-dotted lines, the bell member lies snugly against the inclined inside wall surface of the material container.

The shut-off bell member 6 can be raised and lowered by way of vertical rods 5 which are secured to a mounting means 4, and by way of a linkage system 2 which is pivotal about a horizontal axis 3 and which pivotally engages the mounting means 4. The linkage system 2 is pivotally engaged by a piston of a pneumatically actuated cylinder 1 which is in turn secured to the frame of the apparatus at 9. The shut-off bell member 6 can thus be lowered on to or lifted from the upper end of the cylindrical mixing chamber 8, over the conveyor portion 10, by means of the pneumatically actuated cylinder unit 1 which is controlled from the control desk of the machine by way of the supply line 12, and by way of the linkage system 2 and 5. The stroke length movement required and the annular gap which is produced as a result between the shut-off bell member 6 and the material container 11 can be provided by adjusting the stroke length at the pneumatically actuated cylinder 1. In order to improve the flow ability of the material, the shut-off bell member 6 is of a cylindrical configuration.

The invention is not limited to the embodiment illustrated, for other control means than the above-described pneumatically actuated cylinder are readily possible. The shape of the shut-off bell member can also be different from for example cylindrical, according to structural requirements.

What is claimed is:

1. An apparatus for building up and repairing a vertically extending refractory lining of an industrial furnace or like hot-running vessel, which comprises a centrifugal wheel extending in a horizontal plane and rotatable in the plane for centrifugally depositing a granular refractory material on a portion of the lining to be built up or repaired, a conduit for feeding the granular refractory material to the centrifugal wheel, the conduit having an outlet opening above the wheel, a casing defining a mixing chamber connected to, and opening into, the conduit, a conical container for the granular refractory material connected to the casing and opening into the mixing chamber, the centrifugal wheel, the conduit, the casing and the container having a common axis, a vertical drive shaft for rotating the wheel extending along the axis and passing through the container and mixing chamber, a mounting housing for the drive shaft arranged in the container, a shut-off bell member having a bevelled lower edge, the bell member being slidably mounted on the mounting housing for vertical movement into selected positions wherein the bevelled lower edge defines an annular gap between the container and the mixing chamber or permitting the granular refractory material to flow from the container into the mixing chamber and the bevelled lower edge engages the conical inside wall surface of the conical container for completely closing the annular gap for interrupting the flow, vertical rods secured to the shut-off bell member for vertically moving the bell member, a linkage system having one end attached to the rods and pivotal about a horizontal axis, and a stationary pneumatic motor attached to the other end of the linkage system for pivoting the linkage system and thereby to move the rods and bell member vertically.

* * * * *